US008662118B2

(12) United States Patent
Hunt et al.

(10) Patent No.: US 8,662,118 B2
(45) Date of Patent: Mar. 4, 2014

(54) LIQUID FILLING SYSTEM

(75) Inventors: Gary Wilson Hunt, Waterdown (CA); Mark Andrew Pettenuzzo, Milton (CA)

(73) Assignee: EMCO Wheaton Corp., Ontario (CA)

( * ) Notice: Subject to any disclaimer, the term of this patent is extended or adjusted under 35 U.S.C. 154(b) by 0 days.

(21) Appl. No.: 13/309,362

(22) Filed: Dec. 1, 2011

(65) Prior Publication Data

US 2013/0139902 A1 Jun. 6, 2013

(51) Int. Cl.

| | |
|---|---|
| ***B65B 1/30*** | (2006.01) |
| ***B65B 3/28*** | (2006.01) |
| ***B65B 57/06*** | (2006.01) |
| ***B65B 57/14*** | (2006.01) |
| ***B67C 3/00*** | (2006.01) |

(52) U.S. Cl.
USPC ..... 141/198; 141/206; 141/346; 220/86.2

(58) Field of Classification Search
USPC ..... 141/59, 94, 95, 198, 206, 207, 346; 220/86.2
See application file for complete search history.

(56) References Cited

U.S. PATENT DOCUMENTS

| | | | | |
|---|---|---|---|---|
| 3,295,553 | A * | 1/1967 | Garrett et al. | 137/614.06 |
| 3,590,862 | A | 7/1971 | De Graaf | |
| 3,811,486 | A * | 5/1974 | Wood | 141/208 |
| 3,950,862 | A | 4/1976 | Schiel et al. | |
| 4,453,578 | A * | 6/1984 | Wilder | 141/209 |
| 4,498,844 | A | 2/1985 | Bissell et al. | |
| 4,567,924 | A * | 2/1986 | Brown | 141/207 |
| 4,816,045 | A | 3/1989 | Szlaga et al. | |
| 5,056,570 | A | 10/1991 | Harris et al. | |
| 5,271,438 | A | 12/1993 | Griffin et al. | |
| 5,404,909 | A * | 4/1995 | Hanson | 137/614.06 |

(Continued)

FOREIGN PATENT DOCUMENTS

| | | |
|---|---|---|
| CA | 1042034 | 11/1978 |
| WO | WO 2011/073690 A1 | 6/2011 |

OTHER PUBLICATIONS

Spill-Free Vehicle Refueling System; Proprietor Identic; www.identic.sedokument/10-10-21_adblue_svr_system_for buses .pdf, acknowledged to describe prior art devices (2 pages).

(Continued)

*Primary Examiner* — Timothy L Maust
*Assistant Examiner* — Brandon J Warner
(74) *Attorney, Agent, or Firm* — James B. Conte; Husch Blackwell LLP

(57) ABSTRACT

A coupling has a housing which defines a vacuum chamber and, at least in part, a nozzle chamber. The nozzle chamber forms a valve chamber, an intake chamber, and an outlet chamber. A main valve is in the valve chamber. The main valve is movable between an open and closed position. A poppet valve is in the outlet chamber. An air outlet opens from the vacuum chamber into the nozzle chamber. An opening of an air uptake conduit opens into the vacuum chamber. The air outlet opening is distinct from the opening of the uptake conduit. When the main valve is in the open position the valve chamber is open to the outlet chamber and the outlet chamber is open to the intake chamber. In the closed position, the valve chamber is sealed off from the outlet chamber and the intake chamber is sealed off from the outlet chamber.

14 Claims, 6 Drawing Sheets

(56) References Cited

U.S. PATENT DOCUMENTS

| | | | | |
|---|---|---|---|---|
| 5,645,115 | A * | 7/1997 | Kesterman et al. | 141/206 |
| 5,713,401 | A * | 2/1998 | Weeks | 141/59 |
| 5,755,256 | A | 5/1998 | Elsdon et al. | |
| 5,839,489 | A | 11/1998 | Ganachaud et al. | |
| 5,904,302 | A | 5/1999 | Brown | |
| 6,405,768 | B1 * | 6/2002 | McClaran | 141/346 |
| 6,945,477 | B2 * | 9/2005 | Lambert et al. | 239/542 |
| 7,134,580 | B2 * | 11/2006 | Garrison et al. | 222/566 |
| 7,255,140 | B2 * | 8/2007 | Poli | 141/218 |
| 2009/0218009 | A1 | 9/2009 | Rongstock | |

OTHER PUBLICATIONS

Spill-Free Vehicle Refilling System for Buses; Proprietor Identic; http://www.identic.sedokument/11-01-10_dual_inlet_adaptorfor_adblue.pdf, acknowledged to describe prior art devices (2 pages).

Dual Inlet Adaptor for Spill-Free Vechicle Refilling System; Proprietor Identic; www.identic.sedokument/10-08-24_identic_svr system_nozzle leaflet.pdf, acknowledged to describe prior art devices (2 pages).

* cited by examiner

LIQUID FILLING SYSTEM

FIELD

The present invention relates generally to the technical field of liquid dispensing systems for dispensing liquid into a storage tank.

BACKGROUND

Dry disconnect systems to fuel fleet vehicles, such as for example busses, are known. The fuel systems allow for rapid fueling of buses with minimal leakage of fuel into the environment. One type of dry disconnect system includes a coupling which couples with an adaptor of a fuel tank. In more detail, the coupling is connected to one end of a hose. The other end of the hose is connected to a fuel pump. In use, the coupling, which can be a nozzle, is coupled to the adaptor. Fuel is dispensed from the pump into and through the hose. The fuel passes into and through the coupler. From the coupler the fuel passes into the adaptor. From the adaptor the fuel passes into the fuel tank. The coupler is mechanically coupled and locked to the adapter.

When the adapter is locked onto the coupler, poppet valves of both the coupler and adaptor are displaced by an operator from their seats to permit flow of fluid through the coupler and into the adaptor. When the tank reaches a full level, an overpressure shut-off assembly causes a main valve in the coupler to close and prevents further dispensing of fuel from the coupler. Upon uncoupling of the coupler from the adaptor, the poppet valves are oriented back on the valve seats, sealing off the adaptor opening and the coupler opening. The sealing prevents leakage of the fuel from the coupler and adaptor into the environment.

Vacuum shutoffs are also known. A vacuum shutoff system automatically shuts off the flow of fluid to the fuel tank once the fuel tank is full. U.S. Pat. No. 5,755,256 concerns an automatic shut off filling system. The system includes a nozzle body component associated with a fluid supply and a nozzle extension component for mounting within a container to be filled. The nozzle body component includes a fluid filling nozzle having automatic shut off means actuated in response to changes in pressure within the nozzle body caused by the fluid when it reaches a fill level within the container to be filled. The nozzle body also has a fluid delivery actuation means associated with it. The fluid filling nozzle further includes quick disconnect coupling means for securing the nozzle body component to the fill neck of the container to be filled. A shutoff tube is mounted within a fluid delivery passage located within the coupling means. The shutoff tube is adapted to removably engage an end of a shutoff tube extension associated with the nozzle extension component.

SUMMARY

In an embodiment of the invention a coupling includes a housing. The housing defines at least in part a nozzle chamber. The nozzle chamber forms a valve chamber, an intake chamber, and an outlet chamber. The housing also forms a vacuum chamber. A main valve is in the valve chamber. The main valve is movable between an open and closed position. A poppet valve is in the outlet chamber. An air outlet opens from the vacuum chamber into the nozzle chamber. An opening of an air uptake conduit opens into the vacuum chamber. The air outlet opening is distinct from the opening of the uptake conduit. When the main valve is in the open position the valve chamber is open to the outlet chamber and the outlet chamber is open to the intake chamber. In the closed position, the valve chamber is sealed off from the outlet chamber and the intake chamber is sealed off from the outlet chamber.

DETAILED DESCRIPTION

Figure 1:
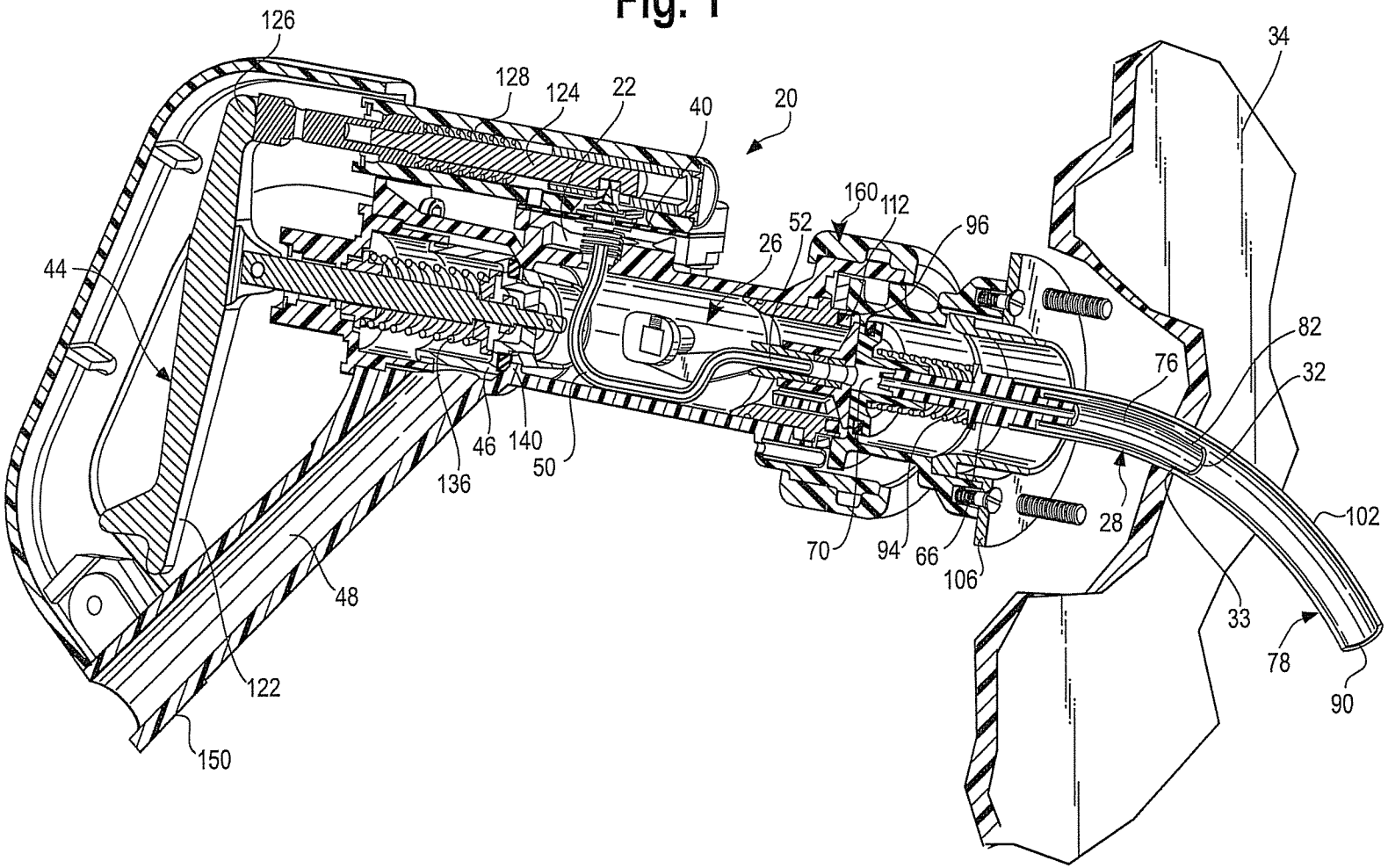
FIG. 1 is a sectional view of an adaptor and nozzle coupled together embodying the present invention; wherein the nozzle and adaptor poppets are closed and the main valve of the nozzle is closed.
Figure 2:
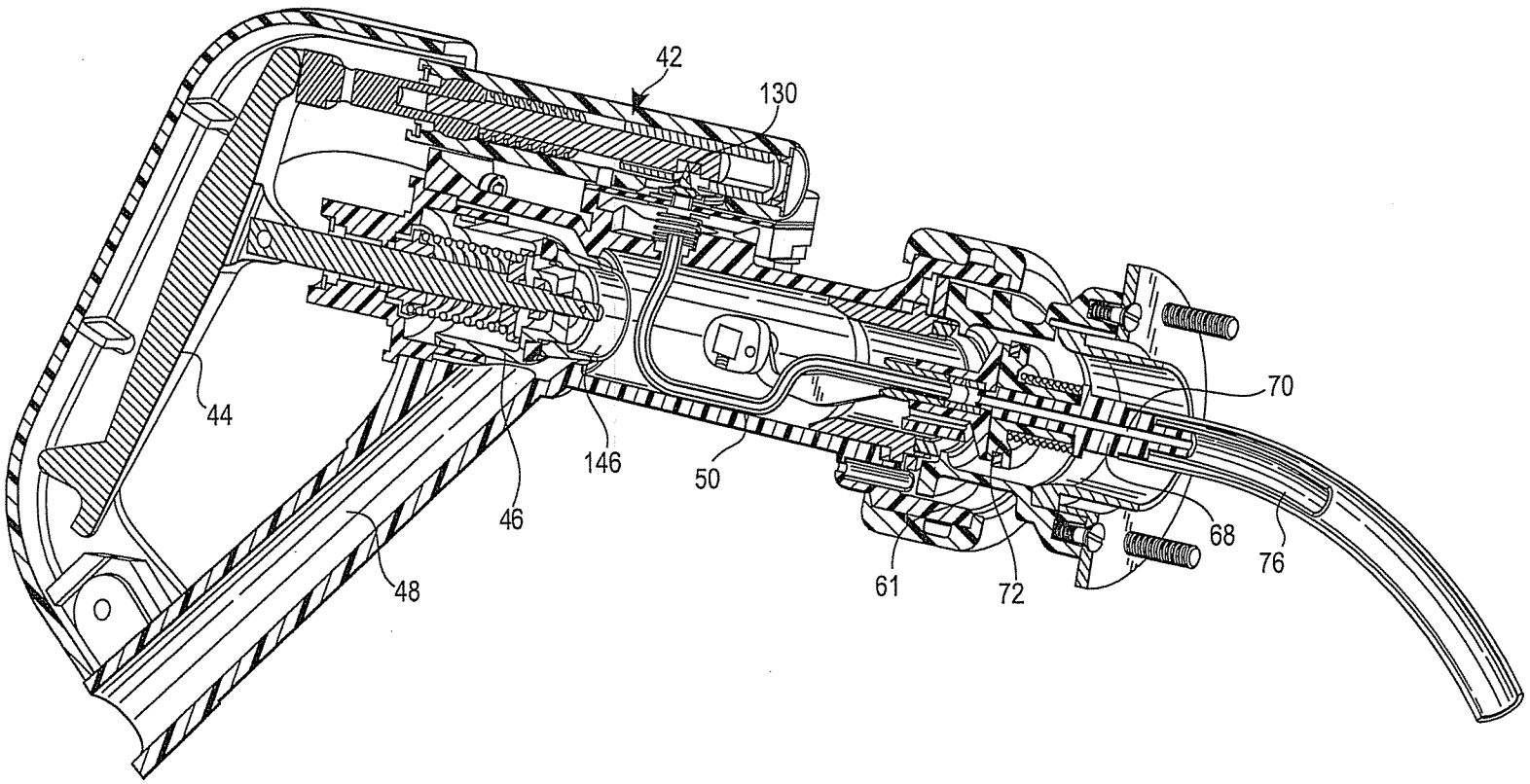
FIG. 2 is a sectional view of an adaptor and nozzle coupled together embodying the present invention; wherein the nozzle and adaptor poppets are open and the main valve of the nozzle is open.
Figure 3:
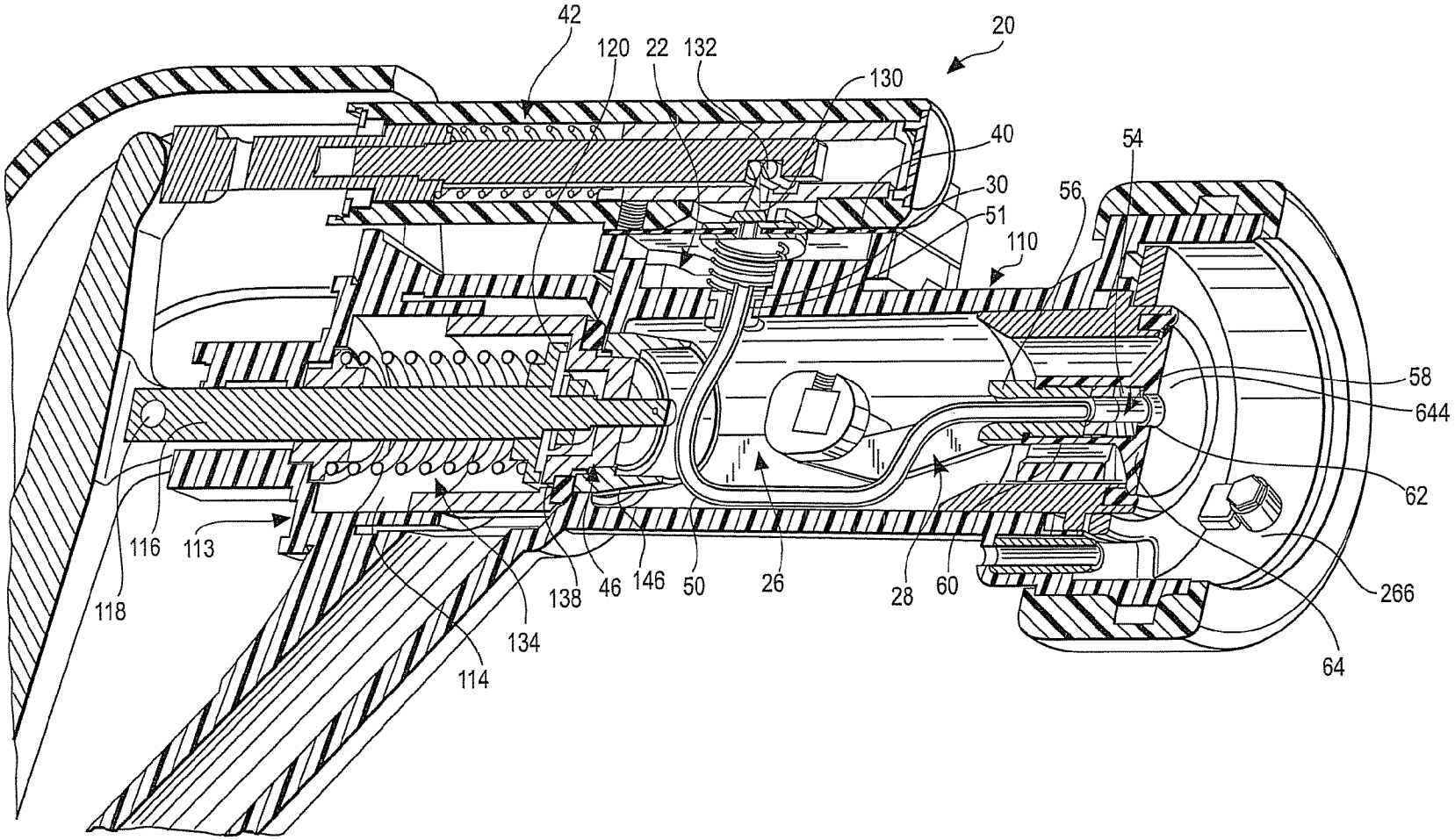
FIG. 3 is a close-up sectional view of the nozzle shown in FIG. 1 wherein the poppet and main valve are closed.
Figure 4:
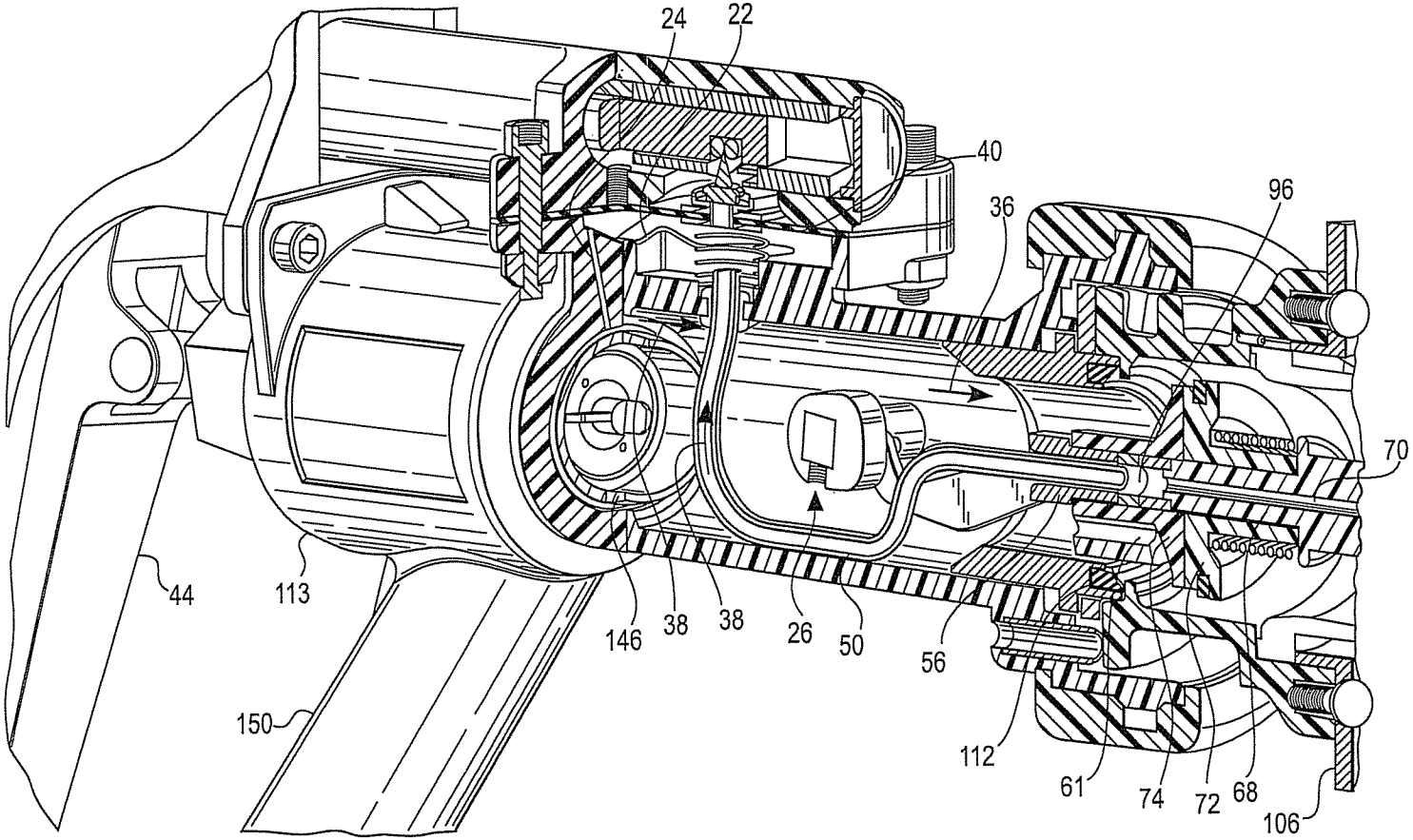
FIG. 4 is a close-up partial and irregular sectional view of the nozzle shown in FIG. 1 wherein the poppet and main valve are open; the section is taken vertically and horizontally through the axis of the nozzle's outlet chamber.
Figure 5:
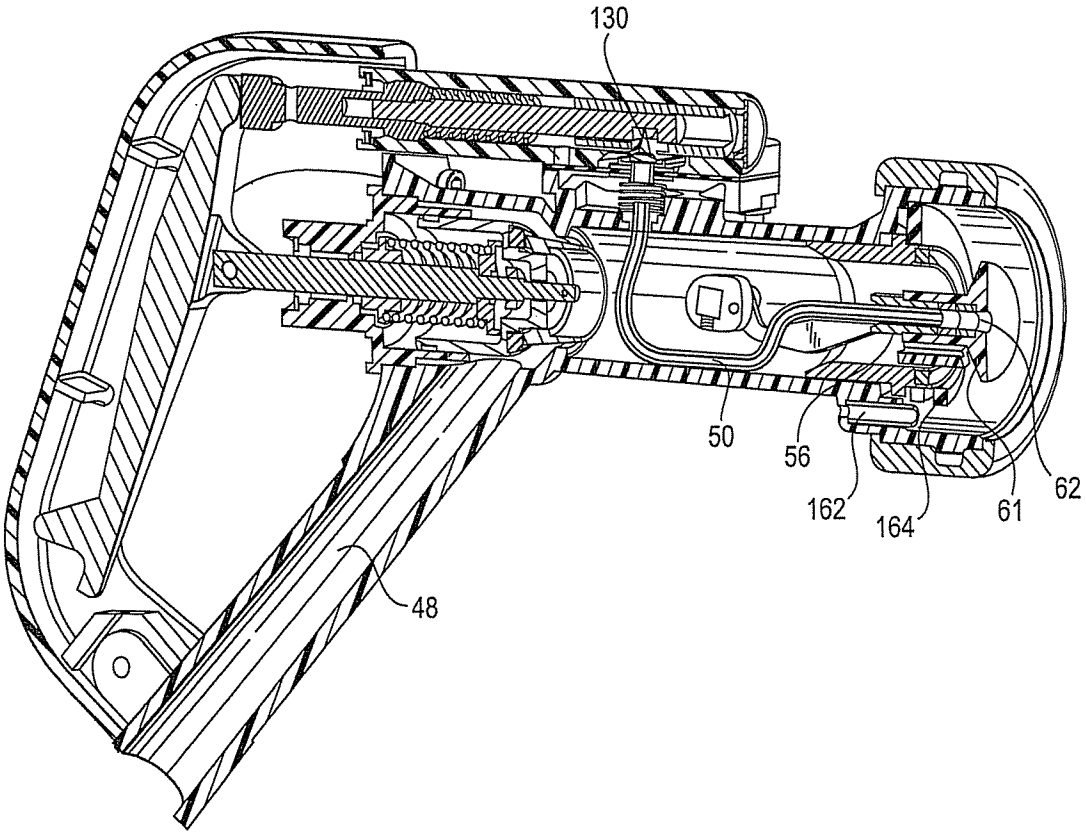
FIG. 5 is a close-up sectional view of the nozzle shown in FIG. 1 wherein the poppet is open.
Figure 6:
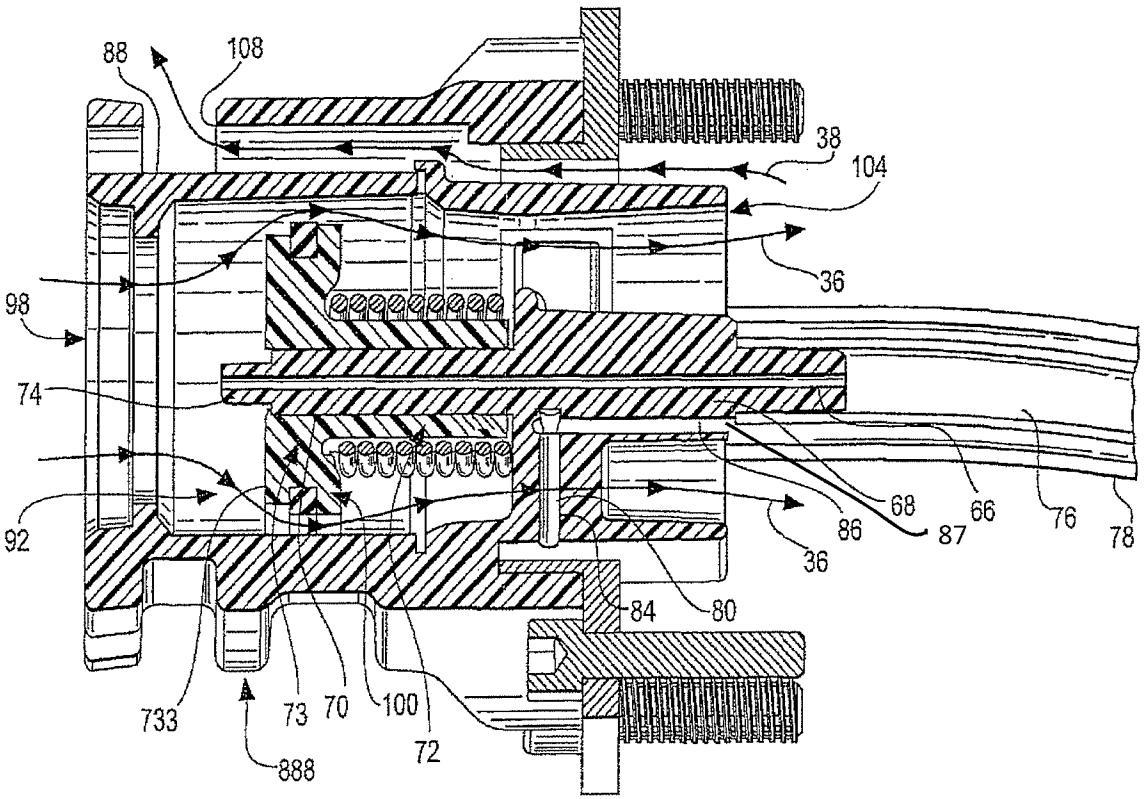
FIG. 6 is a close-up sectional view of the adaptor shown in FIG. 1 wherein the poppet is open.

FIG. 1 shows one embodiment of the present invention and is directed to a filling coupler 20 for a liquid, which in this example is a fuel additive. In this example the coupler 20 is a nozzle. The nozzle has an internal chamber which forms an intake chamber 48, a valve chamber 114, an outlet chamber 26, and a vacuum chamber 22. The nozzle has a main valve 46 in the valve chamber 114 which controls flow of liquid 36 from the nozzle's intake chamber 48 to the nozzle's outlet chamber 26. The outlet chamber 26 houses a poppet valve 61 which is moveable from a closed position to an open position. In the closed position the poppet valve seals an open end 266 of the outlet chamber 26. When the poppet is in the open position the outlet chamber is not sealed. It is open.

In a filling position, the nozzle 20 is coupled to an adaptor 888 of a storage tank 34. The nozzle poppet valve 61 and a poppet valve 72 of the adaptor 888 are in the open position. Upon actuation of the main valve 46 to an open position liquid can flow from the nozzle 20 through the outlet chamber 26, through adaptor 888 and into a storage tank 34.

The nozzle 20 has a vacuum chamber 22. The vacuum chamber opens via an opening 24 into an area of the outlet chamber 26 which borders the valve chamber 114. The opening can be considered between the valve chamber and the outlet chamber. An air and/or vapor uptake conduit 28 has a first opening 30 which opens into the vacuum chamber 22. The conduit 28 includes a channel 62 opening through a head 64 of the nozzle poppet 61. The conduit 28 also includes a channel 66 in a guide 68 for the adaptor poppet 888. In the filling position, a portion 74 of the guide 68 and guide channel 66 extends through a channel 70 of adaptor poppet 72 and into channel 62 of the nozzle poppet. The conduit 28 has a second opening 32 downstream of channel 62 and channel 66. The second opening 32 opens into the storage tank 34 filled by the nozzle. The nozzle includes an interlock pin 162 and an interlock plate 164.

In the filling position, as fuel additive 36 flows out the outlet chamber 26 into the tank 34, it creates a venturi effect at the vacuum chamber opening 24. As a result of the venturi effect, air 38 is drawn out of the vacuum chamber opening and into the outlet chamber 26. At the same time makeup air 38 is drawn into the vacuum chamber 22 though the air uptake conduit 28. The air enters the vacuum chamber 22 through first opening 30. The uptake conduit 28 can also be called a makeup air conduit. The air continues to move in and out of the vacuum chamber 22 until the additive reaches a level in the additive storage tank 34 to close the second opening 32 of the uptake conduit 28. Once the second opening 32 of the air uptake is closed off by the fuel additive 36, air 38 can no longer flow from the air uptake conduit into the vacuum chamber. Air 38 will, however, continue to exit the vacuum chamber 22 due to the venturi effect. Because air continues to exit, pressure in the vacuum chamber 22 decreases. As the pressure in the vacuum chamber 22 decreases, a flexible wall 40, in the form of a diaphragm, bounding a portion of the vacuum chamber begins to collapse inward towards the opening 24. The collapse actuates a trip rod assembly 42 which allows for a rotating movement of a trigger 44 of the nozzle 20 such that the nozzle's main valve 46 moves from an open position to a closed position and seals off the outlet chamber 26 from the nozzle intake chamber 48. The sealing prevents the passage of fluid 36 out the nozzle intake chamber 48 and into the nozzle outlet chamber 26.

In the filling position, the air uptake conduit 28 provides a fluid conduit for air and vapor to travel from the conduit second opening 32 in the tank through the conduit first opening 30 and into the vacuum chamber 22 during filling of the additive 36 into the additive tank 34. The air continues to travel through the conduit 28 so long as the second opening 32 of the conduit 28 is open to ambient air and so long as air 38 is being drawn out of the vacuum chamber 22 through opening 24 by the venturi effect of the fuel additive 36 passing by the vacuum chamber opening 24.

The conduit 28 includes a first tube 50 which extends from the first conduit opening 30 and extends into a channel 54. The channel 54 passes through and is formed by poppet guide 56 for the stem 60 of poppet valve 61. The tube has first end 51 which extends into the vacuum chamber and provides the conduit first opening 30 into the vacuum chamber. The tube has a second end 52 which opens at an end of channel 54. The end is adjacent channel 58 of poppet stem 60. The end 52 of tube 50 and the end of channel 54 of guide 56 opens into channel 58 of poppet stem 60. A portion of the poppet guide 56 fits within the channel 58 of the poppet stem 60. The poppet guide 56 and poppet stem are fixedly coupled so they move as a single component as poppet valve 61 moves from a closed to an open position. The conduit extends from the poppet stem channel 58 through a channel 62 extending through the head 64 of the nozzle poppet 61. A face 644 is formed on the valve head 64 of the poppet Channel 62 extends through the face 644. The channel 62 through the head of the nozzle poppet 61 opens into and around a channel 66 in guide 68 for the adaptor poppet 72. The adaptor poppet guide 68 actually extends into the channel 62 through the face 644 of the nozzle poppet 61. The channel 66 in the adaptor poppet guide 68 extends the entire axial length of the adaptor poppet guide 68 and opens at each axial end of the guide. A portion of the adaptor poppet guide 68 extends into and through a channel 70 formed in the adaptor poppet 72. An end 74 of the adaptor poppet guide protrudes axially through the head 73 and face 733 of the adaptor poppet 72 and into the channel 62 opening through the head 64 of the nozzle poppet 61. The channel 66, at an end of the adaptor poppet guide opposite end 74, is coupled to and opens into a second tube 76 which extends into the additive tank 34. The second tube 76 is within an outer tube 78. A gap can exist between the outer tube and second tube. The uptake conduit 28 is thus formed by the first tube 50, the channel 54 the poppet guide 56 for the nozzle poppet 61, the channel 58 in the nozzle poppet stem 60, the channel 62 through the head 64 and face 644 of the nozzle poppet 61, the channel 66 through the adaptor poppet guide 68, and the second tube 76. The second tube has a free end which forms opening 32.

A makeup passage 80 extending through a portion of the adaptor housing 88 fluidly couples an open free end 82 of the second tube 76 to ambient air. The open free end 82 forms the second opening 32 at the second end 33 of the air uptake conduit 28. The makeup passage 80 has a first end 84 opening through an external surface of the adaptor housing 88. The passage 80 has a second end 86, opening through and end of the housing 88. The opening 87 at the second end 86 is external to the second tube 76 and within the hollow formed by the outer tube 78. The opening 87 is thus radially between an external surface of the second tube 76 and an internal surface of the outer tube 78. In the filling position the passage 80 serves to allow makeup air 38, due to the venturi affect, to be drawn through the adaptor housing 88, via the passage 80, and into the free end 82_(second opening 32) of the second tube 76, when additive is passing by the vacuum chamber opening 24. The passage 80 is particularly useful because the opening 90 of the outer tube at its free end is generally blocked by the additive in the tank. Even when the outer tube 78 is blocked by additive, air will continue to pass from the makeup passage 80 into the air uptake conduit 28 so long as the free end 82, second opening 32, of the second tube 76 is not blocked by additive and additive is passing by the vacuum chamber outlet 24.

The adaptor housing 88 defines a hollow 92 in which the adaptor poppet 72 and the adaptor poppet guide 68 are disposed. A spring 94 is between an abutment of the guide 68 and an underside of the adaptor poppet head 73. The spring 94 biases the poppet 72 in a first closed position. In the first closed position, the poppet is in sealing engagement with an internal wall 96 of the housing. The sealing engagement prevents additive from escaping from the intake end 98 of the adaptor 888. The poppet 72 when pushed in the axial direction by the nozzle poppet 61 away from the adaptor intake end 98, orients to a second filling position. In the second filling position the adaptor is not in sealing engagement with the internal wall 96 of the housing. The adaptor poppet head 73 is off the internal wall. Additive will pass though the adaptor housing 88 through the internal channel formed between the surface of the adaptor housing internal wall 96 and the external surfaces 100 of the adaptor poppet 72, and the external surface 102 of the outer tube 78. The external surface 102 of the outer tube 78 forms a guide along which additive travels into the additive storage tank. The adaptor 888, at its outlet end 104, has a coupling portion 106 to connect the adaptor to the additive storage tank. The adaptor also has a series of vents 108 opening there through to allow escape of the air form the additive storage tank during a filling of the tank.

The nozzle 20 includes a housing with distinctive sections. The housing also forms a hollow with distinctive sections. One section of the nozzle, the nose or spout 110, forms the outlet chamber 26 in which the nozzle poppet 61 and nozzle poppet guide 56 are disposed. A valve seat 112 is also disposed in the outlet chamber 26. The nozzle poppet 61 when in a closed first position is in sealing engagement with the valve seat 112 and seals off the open end 266 of the outlet chamber 26. The valve poppet 61 when in a second open position is off the valve seat 112 and the outlet chamber 26 is open. When the nozzle poppet 61 is in the open position additive can flow through the vale seat 112, around the nozzle poppet 61, and out the outlet chamber 26.

An intermediate or valve holding section 113 of the nozzle forms the valve chamber 114 which houses a valve assembly. The valve assembly seals off the nozzle intake chamber 48 from the nozzle outlet chamber 26. The valve assembly includes a connector rod 116 which is pivotally coupled by a pin 118 to the trigger 44 at one end, and is coupled to a pilot valve 120 and main valve 46 at another end. Moving the first end 122 of the trigger away from the nose 110 moves the connecting rod 116 away from the nose 110 thereby moving the pilot valve 120 and main valve 46 in the axial direction away from the nose. The valves 120 and 46 move from closed positions to open positions. When the main valve 46 is in the open position, the valve chamber 114 is open to the outlet chamber 26 and the intake chamber is open to the outlet chamber. In the closed position the valve chamber 114 is sealed off from the outlet chamber 26 and the intake chamber is sealed off from the outlet chamber.

A trip rod 124, when in a non actuated locked state, provides an abutment to the trigger at a second end 126 of the trigger. The abutment assures moving the trigger first end 122 away from the nose, produces an axial movement of the connecting rod 116 away from the nose. The movement displaces the valves 120, 46 from closed positions to open positions. A spring 128 biases the trip rod 124 in the locked state. A pin 130 extending into a coupling area 132 of the rod, locks the rod in the non-actuated state. The locking prevents axial movement of the rod towards the nose by the second end 126 of the trigger when the trigger first end 122 is pulled axially away from the nose by an operator.

The pilot valve 120 is in a hollow 134 of the main valve, and is biased in a closed position by spring 136. In the closed position the pilot valve 120 sits against seat 138 formed by the main valve 36. The seat 138 can also be called an abutment. The pilot valve in the open position is off the seat. The movement of the trigger moves the pilot valve off seat 138 to the open position before the rod moves the main valve 46 to the open position. Movement of the pilot valve first allows for release of additive in the back of the valve chamber to escape around the pilot valve. The main valve is biased by the spring 136 in the closed position. The main valve 46 is in a closed position when it is in sealing engagement with a seat 140 formed by the internal nozzle housing portion of the valve chamber. The seat 140 can also be called an abutment. In the open position the main valve is off the seat.

Movement of the main valve to the open position allows for additive to flow from the intake chamber 48 through the valve chamber 114 and into the outlet chamber 26. The additive flows between an internal wall of the valve chamber housing and the main valve 46. A restrictor cone 146 coupled to the main valve straddles the valve chamber and outlet chamber. Additive flows around the restrictor cone. The vacuum chamber opening is above the restrictor cone. The restrictor cone 146 limits the size of the opening of the flow path between the valve chamber and outlet chamber; thereby increasing the velocity of the additive which helps to create the venturi effect.

In the actuated unlocked state the pin 130 is out of the coupling area 132 of the rod 124. The pin 130 moves out of the coupling due to a collapse of the diaphragm wall 40 due to the build up of vacuum pressure in the vacuum chamber 22. In the actuated and unlocked state the trip rod 124 does not operate to provide an abutment. The second end 126 of the trigger moves axially forward. The trigger 44 rotates or pivots about the connecting rod 116. The trip rod 124 is moved axially forward by the force of the trigger's second end 126 as the trigger is squeezed by the operator. The connecting rod 116 ceases to be pulled away from the nose 110 of the nozzle.

When the second end 126 of the trigger moves axially forward, the pilot valve 120 and main valve 46 move to the closed position. Spring 136 biases the pilot valve 120 to the closed position in sealing engagement with the seat 138 formed by the main valve. The spring also biases the main valve 46 in the closed position.

An end section 150 of the nozzle forms the additive intake chamber 48 through which the additive flows through the valve chamber when the main valve is in the open position.

The portions of the nozzle and adaptor wetted by the fluid in the case when the fluid is an additive for diesel fuel can be made of plastic which does not react with the additive. A known brand is C13031 Hostaform Acetal by Ticona.

To operate the nozzle 20 a user couples the spout or nose 110 of the nozzle to the adaptor 888 of the additive tank 34. To affect coupling, the nose 110 and the adaptor 888 have an interlocking coupling assembly. The coupling assembly includes a coupling ring 160 mounted to the nose 110 which fits over and locks to intake end 98 of the housing 88 of the adaptor 888. Once coupled an operator actuates a lever (not shown) which moves nozzle poppet 61 axially away from the nozzle intermediate section. The poppet 61 moves off its seat 112. It abuts up against and pushes spring loaded adaptor poppet 72 off its seat 96 towards the adaptor outlet 104. The seat 96 can also be called an abutment. The portion 74 of the adaptor poppet guide 68 having channel 66 extends into channel 62 of the nozzle poppet head 64. The uptake air conduit 28 thus extends from the first opening 30 to the second opening 32.

The actuation of the trigger 44 moves the pilot valve 120 and main valve 46 off their seats 138, 140. Fluid, which in this case is fuel additive, begins to flow from the intake chamber 48, through valve chamber 114, and out the outlet chamber 26. The fluid flows from the outlet chamber 26 through the adaptor housing 88 and into the additive storage tank 34. As the fluid 36 flows through the outlet chamber 26 air is drawn out of the vacuum chamber 22 through the vacuum chamber opening 24, and makeup air 38 is drawn into the vacuum chamber through the makeup passage 80 and the air uptake conduit 28. When the additive in the tank reaches the second opening 32, makeup air ceases to be drawn into the vacuum chamber 22. The vacuum pressure begins to build in the vacuum chamber. Put another way the pressure begins to decrease in the vacuum chamber. The diaphragm wall 40 collapses towards the vacuum chamber opening 24. The trip rod 124 is actuated to the unlocked state. The trigger 44 pivots about connecting rod 116. The pilot valve 120 and the main valve 46 move to the closed positions cutting off the fluid flow.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A coupling comprising:

a housing, said housing defining at least in part a nozzle chamber, said nozzle chamber forms a valve chamber, an intake chamber, and an outlet chamber;

a vacuum chamber formed by said housing;

a main valve in said valve chamber, said main valve being movable between an open position and a closed position;

a poppet valve in said outlet chamber, a channel extending through said poppet valve;

an air outlet opening from said vacuum chamber into said nozzle chamber;

an opening of an air uptake conduit, said opening of said air uptake conduit opening into said vacuum chamber, said air outlet opening being distinct from said opening of said uptake conduit;

wherein when the main valve is in the open position the valve chamber is open to the outlet chamber and the outlet chamber is open to the intake chamber, in the closed position, the valve chamber is sealed off from the outlet chamber and the intake chamber is sealed off from the outlet chamber; and wherein said channel in said poppet valve forms at least a portion of said air uptake conduit.

2. The coupling of claim 1 wherein said channel extends through a head of said poppet valve.

3. The coupling of claim 2 further comprising:

a tube extending from said vacuum chamber, said tube has a first end which forms said opening of said air uptake conduit into said vacuum chamber, said tube coupled to said poppet valve.

4. The coupling of claim 1 wherein said poppet valve includes a stem, said channel extends through said stem.

5. The coupling of claim 4 wherein said poppet valve includes a head and a channel extends through said head, said channel in said head opening into said channel in said stem.

6. The coupling of claim 1 wherein said coupling is coupled to an adaptor of a liquid holding tank, said adaptor comprising:

a housing;

an adaptor poppet valve in said housing.

7. The coupling and adaptor as claimed in claim 6 wherein a part of said air uptake conduit is formed by a channel in an adaptor poppet guide; said adaptor poppet guide in said adaptor housing, said adaptor poppet valve and said adaptor poppet guide coupled to each other.

8. The coupling and adaptor of claim 6 wherein said adaptor poppet valve has a channel extending through said adapter poppet valve.

9. The coupling and adaptor of claim 6 wherein said air uptake conduit has a free end which forms a second opening, said second opening at said free end downstream of an outlet end of said adaptor housing.

10. The coupling of claim 1 wherein said coupling is a nozzle.

11. An adaptor to couple a coupling to a liquid holding tank, said adaptor comprising:

a housing;

a poppet valve in said housing;

a guide in said housing, said guide being coupled to said poppet valve;

a first channel extending through said poppet valve;

a second channel extending through said poppet guide; and wherein one of said first channel in said poppet guide and said second channel in said poppet valve forms a portion of an air uptake conduit.

12. The adaptor of claim 11 wherein said adaptor is coupled to a coupling and said coupling comprises:

a housing, said housing having a nozzle chamber defining at least in part an intake chamber, a valve chamber, and an outlet chamber;

a vacuum chamber defined by said housing;

a main valve in said valve chamber, said main valve being movable between an open position and a closed position;

a coupling poppet valve;

an air outlet opening from said vacuum chamber into said outlet chamber;

a first opening of said air uptake conduit opening in said vacuum chamber, said air outlet opening distinct from said first opening of said air uptake conduit; and wherein when the main valve is in the open position, the valve chamber is open to the outlet chamber and the outlet chamber is opened to the intake chamber, in the closed position, the valve chamber is sealed off from the outlet chamber and the intake chamber is sealed off from the outlet chamber.

13. The coupling and adaptor of claim 12 wherein when the coupling and adaptor are in a filling position, the coupling poppet valve and adaptor poppet valve are in an open position and the main valve is in an open position; and wherein as liquid flows from the outlet chamber through the adaptor housing air is drawn out of the vacuum chamber through the air outlet of the vacuum chamber and a makeup air is drawn into a second opening of the air uptake chamber, through said portion of said uptake conduit in said adaptor and through said first opening of said air uptake conduit and into said intake vacuum chamber, said flow continues so long as liquid filling said liquid holding tank has not reached a level in the storage tank to close said second opening of said air uptake conduit.

14. The adaptor of claim 12 wherein a makeup passage extends through a portion of the adaptor housing and fluidly couples said first opening of said air uptake conduit to ambient air.

* * * * *